US006217776B1

(12) United States Patent
Ohkawa

(10) Patent No.: US 6,217,776 B1
(45) Date of Patent: Apr. 17, 2001

(54) CENTRIFUGAL FILTER FOR MULTI-SPECIES PLASMA

(75) Inventor: Tihiro Ohkawa, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 09/479,276

(22) Filed: Jan. 5, 2000

Related U.S. Application Data

(63) Continuation-in-part of application No. 09/192,945, filed on Nov. 16, 1998, now Pat. No. 6,096,220.

(51) Int. Cl.[7] ..... B03C 1/00

(52) U.S. Cl. ..... 210/695; 210/748; 210/222; 210/243; 209/12.1; 209/227; 96/2; 96/3; 95/28

(58) Field of Search ..... 210/695, 748, 210/222, 243, 223; 209/12.1, 227, 722; 96/1, 2, 3; 95/28

(56) References Cited

U.S. PATENT DOCUMENTS

| | | |
|---|---|---|
| 3,722,677 | 3/1973 | Lehnert . |
| 4,861,477 | 8/1989 | Kimura . |
| 5,039,312 | 8/1991 | Hollis, Jr. et al. . |

OTHER PUBLICATIONS

Bittencourt, J.A., and Ludwig, G.O; Steady State Behavior of Rotating Plasmas in a Vacuum–Arc Centrifuge; *Plasma Physics and Controlled Fusion*, vol. 29, No. 5, pp. 601–620; Great Britain, 1987.

Bonnevier, Björn; Experimental Evidence of Element and Isotope Separation in a Rotating Plasma; *Plasma Physics*, vol. 13; pp. 763–744; Northern Ireland, 1971.

Kim, C.; Jensen, R.V.; and Krishnan, M; Equilibria of a Rigidly Rotating Fully Ionized Plasma Column; *J. Appl. Phys.*, vol. 61, No. 9; pp. 4689–4690; May, 1987.

Dallaqua, R.S.; Del Bosco, E.; da Silva, R.P.; and Simpson, S.W.; Langmuir Probe Measurements in a Vacuum Arc Plasma Centrifuge; *IEEE Transactions on Plasma Science*, vol. 26, No. 3, pp. 1044–1051; Jun., 1998.

Dallaqua, Renato Sérgio; Simpson, S.W. and Del Bosco, Edson; Experiments with Background Gas in a Vacuum Arc Centrifuge; *IEEE Transactions on Plasma Science*, vol. 24, No. 2; pp. 539–545; Apr., 1996.

Dallaqua, R.S.; Simpson, S.W.; and Del Bosco, E; Radial Magnetic Field in Vacuum Arc Centrifuges; *J. Phys. D.Apl. Phys.*, 30; pp. 2585–2590; UK, 1997.

(List continued on next page.)

*Primary Examiner*—David A. Reifsnyder
(74) *Attorney, Agent, or Firm*—Nydegger & Associates

(57) ABSTRACT

A centrifugal filter for separating low-mass particles from high-mass particles in a rotating multi-species plasma includes a pair of annular shaped coaxially oriented conductors. The conductors are both aligned along a central axis and are spaced apart to create a plasma passageway between them. In this configuration, the conductors generate respective magnetic field components which interact to create a magnetic field having an increased magnitude in the passageway and a decreased magnitude along the central axis. The filter also includes an electric field which has a positive potential along the central axis and a decreasing potential in an outwardly radial direction from the central axis. Specifically, this electric field is crossed with the magnetic field in the passageway to confine low-mass particles in the passageway and to eject high-mass particles from the passageway. The particular configuration of the magnetic field for these crossed fields improves efficacy in the separation of the high-mass from the low-mass particles by requiring greater forces for the ejection of particles from the plasma.

14 Claims, 1 Drawing Sheet

OTHER PUBLICATIONS

Evans, P.J.; Paoloni, F. J.; Noorman, J. T. and Whichello, J. V.; Measurements of Mass Separation in a Vacuum–Arc Centrifuge; *J. Appl phys*, 6(1); pp. 115–118; Jul. 1, 1989.

Geva, M.; Krishnan, M; and Hirshfield, J. L.; Element and Isotope Separation in a Vacuum–Arc Centrifuge; *J. Appl. Phys* 56(5); pp. 1398–1413; Sep. 1, 1984.

Krishnan, M.; Centrifugal Isotope Separation in Zirconium Plasma; *Phys. Fluids* 26(9); pp. 2676–2682; Sep., 1983.

Krishnan, Mahadevan; and Prasad, Rahul R.; Parametric Analysis of Isotope Enrichment in a Vacuum–Arc Centrifuge; J. Appl. Phys. 57(11); pp. 4973–4980; Jun., 1, 1985.

Prasad, Rahul R. and Krishnan, Mahadevan; Theoretical and Experimental Study of Rotation in a Vacuum–Arc Centrifuge; *J. Appl. Phys.*, vol. 61, No. 1; pp. 113–119; Jan. 1, 1987.

Prasad, Rahul R. and Mahadevan Krishnan; Article from *J. Appl. Phys.* 61(9); American Institute of Physics; pp. 4464–4470; May, 1987.

Qi, Niansheng and Krishnan, Mahadevan; *Stable Isotope Production*; p. 531.

Simpson, S.W.; Dallaqua, R.S.; and Del Bosco, E.; Acceleration Mechanism in Vacuum Arc Centrifuges; *J. Phys. D: Appl. Phys.* 29; pp. 1040–1046; UK, 1996.

Slepian, Joseph; Failure of the Ionic Centrifuge Prior to the Ionic Expander; p. 1283; Jun., 1955.

Anders, Andre; Interaction of Vacuum–Arc–Generated Macroparticles with a Liquid Surface; *American Institute of Physics*; 1998.

Yoshikawa, Masaji et al.; Plasma Confinement in a Toroidal Quadrupole; *The Physics of Fluids*; vol. 12, No. 9; Sep. 1969.

Ohkawa, Tihiro et al.; Plasma Confinement in dc Octopole; *Physical Review Letters*; vol. 24, No. 3; Jan. 19, 1970.

CENTRIFUGAL FILTER FOR MULTI-SPECIES PLASMA

This application is a continuation-in-part of application Ser. No. 09/192,945, filed Nov. 16, 1998, now U.S. Pat. No. 6,096,220. The contents of Application Serial No. 09/192,945 now U.S. Pat. No. 6,096,220 are incorporated herein by reference.

FIELD OF THE INVENTION

The present invention pertains generally to devices and methods for separating high-mass particles from low-mass particles in a multi-species plasma. More particularly, the present invention pertains to devices and methods for generating a magnetic field which, when crossed with a radially directed electric field, will improve the efficacy of the crossed fields for separating particles in a multi-species plasma and allow for a greater throughput. The present invention is particularly, but not exclusively, useful for a plasma mass filter which confines low-mass particles, but not high-mass particles, to orbits within a definable plasma passageway.

BACKGROUND OF THE INVENTION

In accordance with well known physical principles, whenever a charged particle is placed in an environment wherein a magnetic field is crossed with an electric field (i.e. the magnetic field is perpendicular to the electric field), the charged particle will be forced to move in a direction that is perpendicular to the plane of the crossed fields. For configurations wherein the electric field is radially oriented perpendicular to a central axis, and the magnetic field is oriented parallel to the central axis, the charged particle will be forced to move along circular paths around the central axis. This circular motion, however, generates centrifugal forces on the charged particle that will cause the particle to also move outwardly and away from the central axis.

In addition to the phenomenon described above, it is also known that charged particles will tend to travel through a magnetic field in a direction that is generally parallel to the magnetic flux lines. Thus, for the situation described above wherein the magnetic flux lines are oriented substantially parallel to a central axis of rotation, the magnetic flux lines will generally oppose the centrifugal force that is exerted on a charged particle as the particle rotates about the axis of rotation. It happens, however, that this opposing force is generally proportional to the magnitude of the magnetic field, with a lower magnitude magnetic field giving less opposition to the movement of the particle than a higher magnitude magnetic field.

Because the magnitude of a centrifugal force acting on a charged particle is a function of the mass of the particle, it follows that, for a given condition (i.e. for given crossed electric and magnetic fields), high-mass particles will experience higher centrifugal forces than will low-mass particles. Indeed, plasma centrifuges which are used for the purpose of separating charged particles from each other according to their respective masses (e.g. multi-species plasmas) rely on this fact. Centrifuges, however, also rely on a condition wherein the density of the plasma in the centrifuge chamber is above its so-called "collisional density" and on the fact that the electric field is directed away from the axis of rotation. In comparison with a plasma centrifuge, for a condition wherein the density of the plasma is maintained below the "collisional density" and wherein the electric field is directed toward the axis of rotation, a much different result is obtained.

It can be mathematically shown that when using a cylindrical shaped chamber which has a wall that is located at a distance "a" from the central longitudinal axis of the chamber; with a magnetic field, $B_z$, oriented in a direction substantially parallel to the longitudinal axis of the chamber; and with an electric field established with a positive potential "$V_{ctr}$" on the longitudinal axis and a substantially zero potential on the wall, where "e" is the electric charge on the ion, an expression pertains wherein: $M_c=ea^2(B_z)^2/8V_{ctr}$. In this expression, $M_c$ is an effective cut-off mass which differentiates between high-mass particles and low-mass particles. For environments inside a plasma chamber wherein the mass of a multi-species plasma is maintained below its "collisional density," $M_c$ can be established such that the high-mass particles in a multi-species plasma (i.e. those particles which have a mass greater than the cut-off mass) will be ejected into the wall of the chamber as the plasma transits the chamber. Low-mass particles, on the other hand, will not be ejected during their transit of the chamber.

Recall that the movement of charged particles in a direction which is across or perpendicular to the magnetic flux lines will be generally opposed by the magnetic field. Further, this opposition will be generally proportion to the magnitude of the magnetic field. Like other magnetic field environments, this opposition also pertains to the specific situation for a plasma rotating around an axis and in an environment wherein the electric field is directed to extract ions resulting in a cut-off mass of $M_c=ea^2(B_z)^2/8V_{ctr}$. Thus, by decreasing the magnitude of the magnetic field near the central axis of rotation in a cylindrical shaped plasma chamber, there will be decreased resistance to the outwardly radial movement of rotating charged particles away from the central axis. At the same time, because low-mass charged particles will experience lower centrifugal forces than will the high-mass particles, the low-mass particles will react more slowly and, therefore, will be more likely to remain nearer the central axis. Consequently, these trends will facilitate the movement of high-mass charged particles away from the central axis and into the region of the plasma chamber where the expression, $M_c=ea^2(B_z)^2/8V_{ctr}$ becomes more effectively operable. Importantly, with an increased efficacy in the separating of particles, there is also the ability to increase throughput.

In light of the above, it is an object of the present invention to provide a centrifugal mass filter which, for given crossed magnetic and electric fields, will facilitate the movement of both high-mass and low-mass charged particles into a region where they can be effectively separated from each other. It is another object of the present invention to provide a centrifugal mass filter which more predictably confines low-mass particles in the chamber, and more predictably ejects high-mass particles from the chamber, during their respective transit through the chamber. Yet another object of the present invention is to provide a centrifugal mass filter which will effectively process increased throughput. It is another object of the present invention to provide a centrifugal mass filter which is relatively easy to manufacture, is easy to operate and is comparatively cost effective.

SUMMARY OF THE PREFERRED EMBODIMENTS

A centrifugal filter for separating low-mass particles from high-mass particles in a rotating multi-species plasma includes a first annular shaped conductor and a second annular shaped conductor. For the present invention, both of these annular shaped conductors are aligned and oriented along a central longitudinal axis in a coaxial configuration. Thus, they are also coaxially oriented relative to each other. A substantially cylindrical shaped container is also aligned along the central axis with the wall of the container positioned between the conductors. Specifically, one of the annular shaped conductors (the outer conductor) is mounted on the outer surface of the container wall, while the other conductor (the inner conductor) is positioned around and adjacent to the central axis. More specifically, the inner conductor is distanced from the inner surface of the container wall and is located in a plasma passageway that is established between the inner surface of the container wall and the central axis. The portion of this plasma passageway that is located between the inner conductor and the central axis is used to receive a multi-species plasma into the container and is hereinafter referred to as a central passageway.

As intended for the present invention, the outer annular shaped conductor and the inner annular shaped conductor respectively generate magnetic field components, $B_{z1}$ and $B_{z2}$. Specifically, these components are generated such that $B_{z1}$ and $B_{z2}$ are additive. In the plasma passageway between the inner surface of the container wall and the inner conductor, the magnitude of the magnetic field is at its maximum and is such that $B_{z1}+B_{z2}=B_z$. On the other hand, the magnetic field components $B_{z1}$ and $B_{z2}$ oppose each other in the central passageway between the inner conductor and the central axis. In the central passageway the magnetic field components $B_{z1}$ and $B_{z2}$ such that $B_{z1}+B_{z2}\cong 0$ along the central longitudinal axis or is, at least, minimal. The result is an increased magnetic field in the plasma passageway between the inner surface of the container wall and the inner conductor and a decreased magnetic field in the central passageway. As intended for the present invention, this configuration for the magnetic field creates a condition in which the efficacy of the filter is improved by facilitating the movement of charged particles from the central axis into the plasma passageway. More specifically, this condition favors the movement of high-mass particles and allows them to concentrate in the passageway where they can be more predictably separated from the low-mass particles. A consequence of this is that the filter can handle a greater throughput.

Preferably, for the present invention the outer conductor for generating the magnetic field component ($B_{z1}$) is a magnetic coil that is mounted on the outer surface of the wall. The inner conductor, which is used for generating the magnetic field component ($B_{z2}$), is preferably a plurality of magnetic loops which encircle the longitudinal axis and are located in the passageway at a distance from the inner surface of the wall. The present invention also includes means, such as concentric ring electrodes, which are mounted at one end of the passageway for establishing an electric field, $E_r$, that is oriented substantially perpendicular to the magnetic field ($B_z$).

For the operation of the centrifugal filter of the present invention, the container passageway is dimensioned such that the inner surface of the container wall is at a distance "a" from the central longitudinal axis. Additionally, the magnetic field in the passageway is oriented substantially parallel to the central longitudinal axis, and has a magnitude which varies between a maximum, $B_z$ in the passageway, to a minimum of approximately zero along the central axis. Further, the electric field ($E_r$) is established in the passageway to be substantially perpendicular to the magnetic field ($B_z$). Importantly, $E_r$ increases linearly with the radius and is determined by a positive potential on the central longitudinal axis equal to "$V_{ctr}$", and a substantially zero potential at the inner surface of the container wall. With this configuration, when a rotating multi-species plasma is injected into the central passageway, high-mass particles in the plasma which have a mass ($M_2$) that is greater than a predetermined cut-off mass ($M_c$) will tend to concentrate farther from the central axis than will low-mass particles which have a mass ($M_1$) that is less than $M_c$. The high-mass particles can then be more predictably ejected into the inner wall of the container where they can be subsequently collected. On the other hand, low-mass particles which have a mass ($M_1$) that is less than $M_c$ will not be ejected from the passage away and, instead, will transit through the container. For the present invention $M_1<M_c<M_2$, where: $M_c=ea^2(B_z)^2/8V_{ctr}$.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
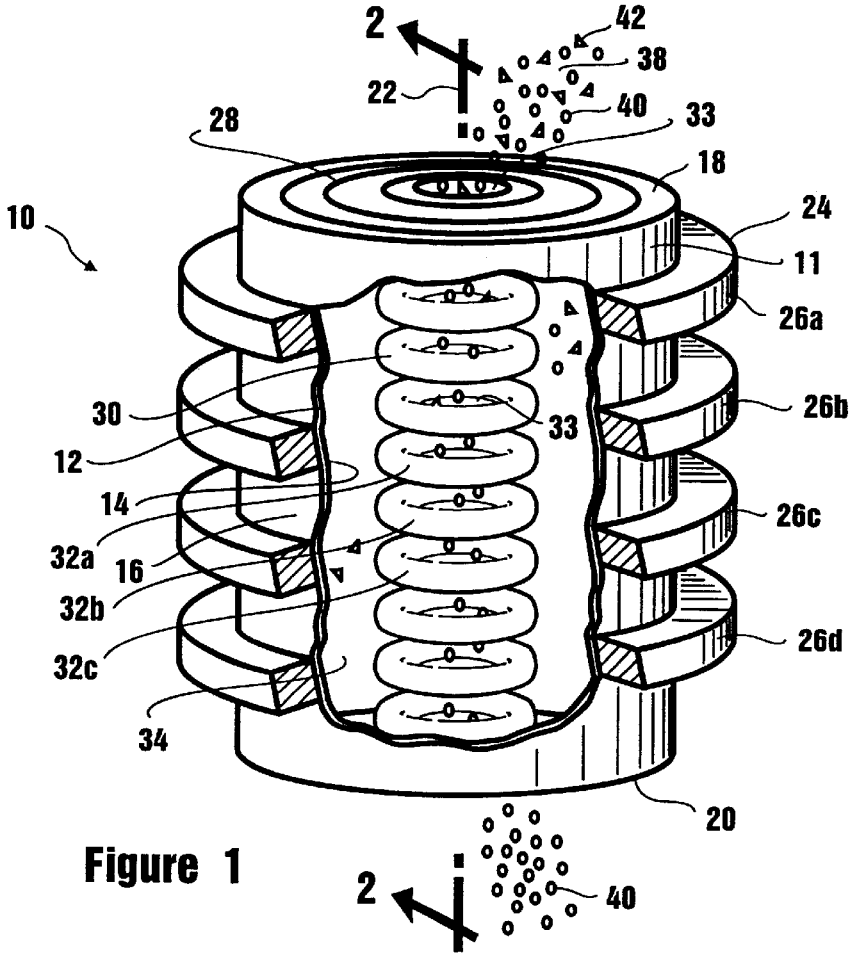
FIG. 1 is a perspective view of the centrifugal mass filter of the present invention with portions broken away for clarity.

Referring initially to FIG. 1 a centrifugal mass filter in accordance with the present invention is shown and generally designated 10. As shown, the filter 10 preferably includes a cylindrical shaped container 11 with a wall 12 having an inner surface 14 and an outer surface 16. The container 11 has a substantially open end 18 and a substantially open end 20 and is oriented on a central axis 22.

FIG. 1 also shows that an outer conductor 24 comprising a plurality of annular coils 26 (of which the coils 26*a*, 26*b*, 26*c* and 26*d* are representative) is mounted on the outer surface 16 of the container wall 12. For the particular embodiment of the centrifugal mass filter 10 shown in FIG. 1, there is also an electrode 28 which comprises a plurality of concentric rings that are positioned at the end 18 of container 11 around the central axis 22. For the filter 10 of the present invention, this electrode 28 is used to establish a positive potential, $V_{ctr}$, on the axis 22. It will be appreciated, however, that the electrode 28 or, alternatively, a spiral electrode (not shown), can be positioned at either end 18 or end 20 (or both) of container wall 12 for this purpose. Importantly, the electrical potential at the container wall 12 will be approximately zero so that a radially oriented electrical field, $E_r$, is established between the central axis 22 and the container wall 12 substantially as shown in FIG. 2.

FIG. 1 shows that the filter 10 of the present invention includes an inner conductor 30 which comprises a plurality of coils 32 (of which the coils 32*a*, 32*b* and 32*c* are representative). In both FIG. 1 and FIG. 2 it will be seen that the inner conductor 30 surrounds a central passageway 33 inside the container 11. With this structure, the filter 10 is configured to establish a plasma passageway 34 which extends from end 18 to end 20 between the inner surface 14 of the container wall 12 and the central axis 22. Note the central passageway 33 is a portion of the larger plasma passageway 34.

Figure 2:
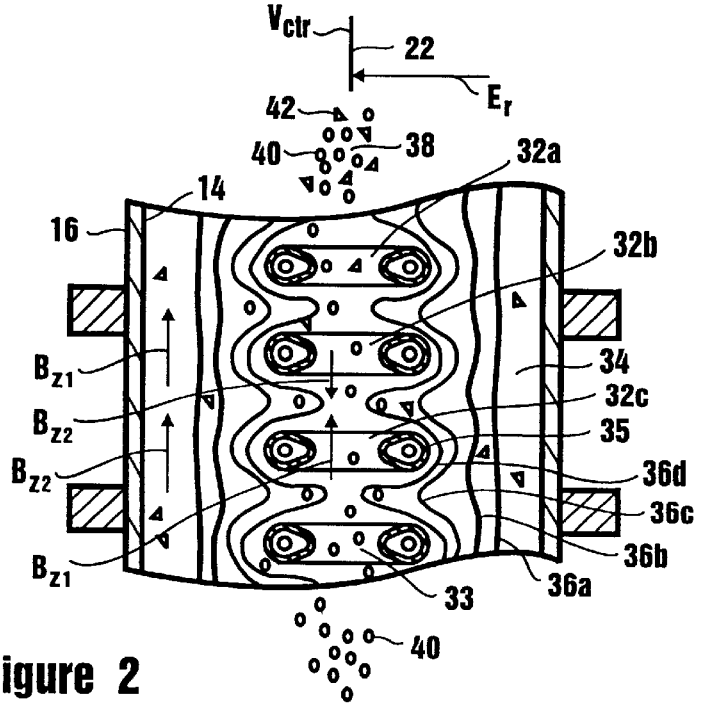
FIG. 2 is a cross sectional view of a portion of the centrifugal mass filter as seen along the line 2—2 in FIG. 1.

In accordance with earlier disclosure, it will be appreciated that the radially oriented electric field $E_r$ is established in this passageway 34 and is oriented substantially perpendicular to the central axis 22 (see FIG. 2). Also, a magnetic field $B_z$ is established in the passageway 34 by the concerted effects of both the outer conductor 24 and the inner conductor 30 which will be oriented substantially parallel to the central axis 22. The magnetic field Bz will, therefore, be crossed with the electric field $E_r$ in the passageway 34.

For the present invention it is preferred that the outer conductor 24 and the inner conductor 30 generate respective magnetic field component $B_{z1}$ and $B_{z2}$, which are additive in the passageway 34. More specifically, as substantially shown in FIG. 2, these components are additive between the inner surface 14 of the container wall 12 and the inner conductor 30 such that $B_{z1}+B_{z2}=B_z$. On the other hand, as also shown in FIG. 2, these components are additive such that $B_{z1}+B_{z2}\cong 0$ or is, at least, minimal in the central passageway 33 near the central axis 22. The particular configuration of the magnetic field can, to some extent, be determined by the use of casings 35 (see coil 32*c*) which can be placed around each of the annular coils 32. The result of all this for the magnetic field in the passageway 34 is best exemplified by the magnetic flux lines 36 shown in FIG. 2 (of which the flux lines 36*a*, 36*b*, 36*c* and 36*d* are representative).

In the operation of the filter 10 of the present invention, an electrical field, $E_r$, is established in the passageway 34 with positive potential, $V_{ctr}$, on the central axis 22, and a substantially zero potential at the container wall 12. Further, a magnetic field, $B_z$, is established in the passageway 34. Specifically, the magnetic field, $B_z$, that is generated by the combined outputs of outer conductor 24 and inner conductor 30, and is oriented in the passageway such that $E_r$ and $B_z$ are crossed with each other. The magnitude of the magnetic field, $B_z$, and the magnitude of the positive potential, $V_{ctr}$, for the electric field, $E_r$, are then established such that $M_c=ea^2(B_z)^2/8V_{ctr}$, where "a" is effectively the radial distance from the central axis 22 to the container wall 12 and "e" is the ion charge. A rotating multi-species plasma 38 is then injected into the central passageway 33 through the end 18.

Typically, as envisioned for the present invention, the multi-species plasma 38 will include various types of specific elements which can be generally classified as either low-mass particles 40, having a representative mass, $M_1$, or high-mass particles 42, having a representative mass, $M_2$. Importantly, $M_c$ is established so that $M_1<M_c<M_2$. The consequence of establishing $M_c=ea^2(B_z)^2/8V_{ctr}$ is that the low-mass particles 40 ($M_1$) will be confined within the passageway 34 during their transit through the filter 10, while the high-mass particles 42 ($M_2$) will be ejected into the container wall 12 before they can completely transit the filter 10. Further, the configuration of the magnetic field that is created by the combined outputs of the outer conductor 24 ($B_{z1}$) and inner conductor 30 ($B_{z2}$), wherein the magnitude of the magnetic field varies from $B_z$ in the passageway 34 down to approximately zero on the central axis 22, facilitates the separation of high-mass particles 42 from the low-mass particles 40. Specifically, due to the configuration of the magnetic field, the high-mass particles 42 tend to concentrate in the passageway 34 at a distance from the central axis 22 where the expression $M_c=ea^2(B_z)^2/8V_{ctr}$ is most effective. The beneficial consequence of this is that the filter 10 is able to increase it throughput over what would otherwise be realizable.

While the particular Centrifugal Filter for Multi-species Plasma as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A centrifugal filter for separating low-mass particles from highmass particles in a rotating multi-species plasma which comprises:

a first annular means for generating a magnetic field component (Bz1), said first annular means defining a longitudinal axis;

a second annular means for generating a magnetic field component (Bz2), said second annular means being substantially coaxial with said first annular means and distanced therefrom to establish a passageway for said multi-species plasma therebetween, said magnetic field component (Bz1) being additive with said magnetic field component (Bz2) in said plasma passageway to create a magnetic field (Bz);

means for establishing an electric field substantially perpendicular to said magnetic field (Bz) to create crossed magnetic and electric fields in said passageway, said electric field having a positive potential on said longitudinal axis with a decreasing potential in an outwardly radial direction; and means for injecting said rotating multi-species plasma into said passageway to interact with said crossed magnetic and electric fields for ejecting said high-mass particles from said passageway in an outwardly radial direction and for confining said low-mass particles in said passageway during transit therethrough to separate said low-mass particles from said high-mass particles.

2. A centrifugal filter as recited in claim 1 further comprising a substantially cylindrical shaped container, said container being oriented on said longitudinal axis and having a wall extending between an open first end and an open second end, said wall of said container being located between said first annular means and said second annular means to establish said passageway between said wall and said second annular means.

3. A centrifugal filter as recited in claim 2 wherein said wall is at a distance "a" from said longitudinal axis, wherein said magnetic field is oriented in a direction along said longitudinal axis, wherein said positive potential on said longitudinal axis has a value "$V_{ctr}$", wherein said wall has a substantially zero potential, wherein "e" is the electric charge of the ion, and wherein said low-mass particle has a mass less than $M_c$, where $$M_c=ea^2(B_z)^2/8V_{ctr}.$$

4. A centrifugal filter as recited in claim 2 further comprising means for varying said magnitude ($B_z$) of said magnetic field.

5. A centrifugal filter as recited in claim 2 further comprising means for varying said positive potential ($V_{ctr}$) of said electric field at said longitudinal axis.

6. A centrifugal filter as recited in claim 2 where in said wall has an inner surface defining a boundary for said passageway and an outer surface, and wherein said first annular means for generating said magnetic field component ($B_{z1}$) is a magnetic coil mounted on said outer surface of said wall.

7. A centrifugal filter as recited in claim 6 wherein said second annular means for generating said magnetic field component ($B_{z2}$) is a plurality of magnetic loops aligned substantially parallel to said longitudinal axis and located across said passageway from said inner surface of said wall.

8. A centrifugal filter as recited in claim 1 wherein said means for generating said electric field is a series of conducting rings mounted on said longitudinal axis at, at least, one end of said chamber.

9. A centrifugal filter as recited in claim 1 wherein said means for generating said electric field is a spiral electrode.

10. A method for separating low-mass particles from high-mass particles in a rotating multi-species plasma which comprises the steps of:

generating a magnetic field component ($B_{z1}$) with a first annular means, said first annular means defining a longitudinal axis;

generating a magnetic field component ($B_{z2}$) with a second annular means, said second annular means being substantially coaxial with said first annular means and distanced therefrom to establish a passageway for said multi-species plasma therebetween, said magnetic field component ($B_{z1}$) being additive with said magnetic field component ($B_{z2}$) in said plasma passageway to create a magnetic field ($B_z$);

establishing an electric field substantially perpendicular to said magnetic field ($B_z$) to create crossed magnetic and electric fields in said passageway, said electric field having a positive potential on said longitudinal axis with a decreasing potential in an outwardly radial direction; and injecting said rotating multi-species plasma into said passageway to interact with said crossed magnetic and electric fields for ejecting said high-mass particles from said passageway in an outwardly radial direction and for confining said low-mass particles in said passageway during transit therethrough to separate said low-mass particles from said high-mass particles.

11. A method as recited in claim 10 wherein said electric field has substantially zero potential at a distance "a" from said longitudinal axis, wherein said magnetic field is oriented in a direction along said longitudinal axis, wherein said positive potential on said longitudinal axis has a value "$V_{ctr}$", wherein said wall has a substantially zero potential, wherein "e" is the ion electrical charge, and wherein said low-mass particle has a mass less than $M_c$, where $$M_c = ea^2(B_z)^2/8V_{ctr}.$$

12. A method as recited in claim 10 further comprising the steps of:

varying said magnitude ($B_z$) of said magnetic field; and varying said positive potential ($V_{ctr}$) of said electric field at said longitudinal axis.

13. A method as recited in claim 10 further comprising the steps of:

providing a substantially cylindrical shaped container, said container having a wall extending between an open first end and an open second end; and orienting said container on said longitudinal axis with said wall of said container located between said first annular means and said second annular means to establish said passageway between said wall and said second annular means.

14. A method as recited in claim 13 wherein said wall has an inner surface defining a boundary for said passageway and an outer surface, and wherein said first annular means for generating said magnetic field component ($B_{z1}$) is a magnetic coil mounted on said outer surface of said wall and wherein said second annular means for generating said magnetic field component ($B_{z2}$) is a plurality of magnetic loops aligned substantially parallel to said longitudinal axis and located across said passageway from said inner surface of said wall.

* * * * *

UNITED STATES PATENT AND TRADEMARK OFFICE

CERTIFICATE OF CORRECTION

PATENT NO. : 6,217,776 B1
DATED : April 17, 2001
INVENTOR(S) : Tihiro Ohkawa

It is certified that error appears in the above-identified patent and that said Letters Patent is hereby corrected as shown below:

Column 6,
Line 9, delete [ highmass ] insert -- high mass --
Line 12, delete [ (Bz1) ] insert -- ($B_{z1}$) --
Line 15, delete [ (Bz2) ] insert -- ($B_{z2}$) --
Line 19, delete [ (Bz1) ] insert -- ($B_{z1}$) --
Line 20, delete [ (Bz2) ] insert -- ($B_{z2}$) --
Line 21, delete [ (Bz) ] insert -- ($B_z$) --
Line 23, delete [ (Bz) ] insert -- ($B_z$) --

Signed and Sealed this

Eleventh Day of December, 2001

*Attest:*

Nicholas P. Godici

*Attesting Officer*

NICHOLAS P. GODICI
*Acting Director of the United States Patent and Trademark Office*